US008430169B2

(12) United States Patent
Stoisits et al.

(10) Patent No.: US 8,430,169 B2
(45) Date of Patent: Apr. 30, 2013

(54) METHOD FOR MANAGING HYDRATES IN SUBSEA PRODUCTION LINE

(75) Inventors: Richard F. Stoisits, Kingwood, TX (US); David C. Lucas, The Woodlands, TX (US); Larry D. Talley, Friendswood, TX (US); Donald P. Shatto, Houston, TX (US); Jiyong Cai, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 225 days.

(21) Appl. No.: 12/670,994

(22) PCT Filed: Aug. 21, 2008

(86) PCT No.: PCT/US2008/073891

§ 371 (c)(1),
(2), (4) Date: Jan. 27, 2010

(87) PCT Pub. No.: WO2009/042319

PCT Pub. Date: Apr. 2, 2009

(65) Prior Publication Data

US 2010/0193194 A1 Aug. 5, 2010

Related U.S. Application Data

(60) Provisional application No. 60/995,134, filed on Sep. 25, 2007.

(51) Int. Cl.
*E21B 43/01* (2006.01)

(52) U.S. Cl.
USPC ..... 166/344; 166/352; 166/366; 166/369; 166/370; 137/7

(58) Field of Classification Search ..... 166/335, 166/344, 351, 352, 366, 369, 268, 311, 370; 134/8, 22.11; 137/3, 7, 12, 14, 15.04, 15.05
See application file for complete search history.

(56) References Cited

U.S. PATENT DOCUMENTS 3,372,753 A 3/1968 Tuttle
3,514,274 A 5/1970 Cahn et al.

(Continued)

FOREIGN PATENT DOCUMENTS

CA 2036084 8/1991
CN 1429896 7/2003

(Continued)

OTHER PUBLICATIONS

Stoisits, R. F. et al., "Deep Water Single Production Line Tiebacks Achieving Operability Requirements While Minimizing Cost", 16th Annual Deep Water Offshore Technology Conference, Nov. 30-Dec. 2, 2004, pp. 1-12, New Orleans, LA.

(Continued)

*Primary Examiner* — Matthew Buck
(74) *Attorney, Agent, or Firm* — ExxonMobil Upstream Research Company Law Dept.

(57) ABSTRACT

A method for managing hydrates in a subsea production system is provided. The production system includes a host production facility, a control umbilical, at least one subsea production well, and a single production line. The method generally comprises producing hydrocarbon fluids from the at least one subsea production well and through the production line, and then shutting in the production line. In addition, the method includes the steps of depressurizing the production line to substantially reduce a solution gas concentration in the produced hydrocarbon fluids, and then repressurizing the production line to urge any remaining gas in the free gas phase within the production line back into solution. The method also includes displacing production fluids within the production line by moving displacement fluids from a service line within the umbilical line and into the production line. The displacement fluids preferably comprise a hydrocarbon-based fluid having a low dosage hydrate inhibitor (LDHI).

23 Claims, 5 Drawing Sheets

U.S. PATENT DOCUMENTS 4,267,043 A 5/1981 Benson
4,328,098 A 5/1982 Benson
4,528,041 A 7/1985 Rickey et al.
4,574,830 A 3/1986 Rickey et al.
4,589,434 A 5/1986 Kelley
4,687,585 A 8/1987 Ramshaw
4,697,426 A 10/1987 Knowles
4,883,582 A 11/1989 McCants
4,915,176 A 4/1990 Sugier et al.
4,973,775 A 11/1990 Sugier et al.
5,055,178 A 10/1991 Sugier et al.
5,178,641 A 1/1993 Konrad et al.
5,244,878 A 9/1993 Sugier et al.
5,283,001 A 2/1994 Gregoli et al.
5,284,581 A 2/1994 Benson
5,286,376 A 2/1994 Benson
5,426,258 A 6/1995 Thomas et al.
5,427,680 A 6/1995 Benson
5,434,323 A 7/1995 Durand et al.
5,490,562 A 2/1996 Arnold
5,491,269 A 2/1996 Colle et al.
5,536,893 A 7/1996 Gudmundsson
5,600,044 A 2/1997 Colle et al.
5,639,313 A * 6/1997 Khalil ..... 134/18
5,676,848 A 10/1997 Benson
5,741,758 A 4/1998 Pakulski
5,744,665 A 4/1998 Costello et al.
5,816,280 A 10/1998 Rojey et al.
5,817,898 A 10/1998 Delion et al.
5,841,010 A 11/1998 Rabeony et al.
5,842,816 A 12/1998 Cunningham
5,863,301 A 1/1999 Grosso et al.
5,874,660 A 2/1999 Colle et al.
5,877,361 A 3/1999 Rojey et al.
5,879,561 A 3/1999 Klomp et al.
5,888,407 A 3/1999 Benson
5,893,642 A 4/1999 Hewitt et al.
5,900,516 A 5/1999 Talley et al.
5,927,901 A 7/1999 Graves
5,936,040 A 8/1999 Costello et al.
5,941,096 A 8/1999 Gudmundsson
5,954,950 A 9/1999 Morel et al.
5,958,844 A 9/1999 Sinquin et al.
6,015,929 A 1/2000 Rabeony et al.
6,022,421 A 2/2000 Bath et al.
6,025,302 A 2/2000 Pakulski
6,028,233 A 2/2000 Colle et al.
6,028,234 A 2/2000 Heinemann et al.
6,080,704 A 6/2000 Halliday et al.
6,082,118 A 7/2000 Endrizzi et al.
6,102,986 A 8/2000 Klug
6,107,531 A 8/2000 Colle et al.
6,139,644 A * 10/2000 Lima ..... 134/8
6,152,993 A 11/2000 Klomp
6,177,497 B1 1/2001 Klug et al.
6,180,843 B1 1/2001 Heinemann et al.
6,194,622 B1 2/2001 Peiffer
6,214,091 B1 4/2001 Klomp
6,281,274 B1 8/2001 Bakeev et al.
6,307,191 B1 * 10/2001 Waycuilis ..... 219/687
6,331,508 B1 12/2001 Pakulski
6,336,238 B1 1/2002 Tarlton
6,350,928 B1 2/2002 Waycuilis et al.
6,359,047 B1 3/2002 Thieu et al.
6,369,121 B1 4/2002 Catalfamo et al.
6,379,612 B1 4/2002 Reizer et al.
6,412,135 B1 7/2002 Benson
6,444,852 B1 9/2002 Milburn et al.
6,451,892 B1 9/2002 Bakeev et al.
6,536,461 B2 3/2003 Decker et al.
6,536,528 B1 * 3/2003 Amin et al. ..... 166/369
6,539,778 B2 * 4/2003 Tucker et al. ..... 73/49.5
6,550,960 B2 4/2003 Catalfamo et al.
6,566,309 B1 5/2003 Klug et al.
6,596,089 B2 7/2003 Smith et al.
6,656,366 B1 12/2003 Fung et al.
6,672,391 B2 1/2004 Anderson et al.
6,703,534 B2 3/2004 Waycuilis et al.
6,752,214 B2 * 6/2004 Amin et al. ..... 166/369
6,756,021 B2 6/2004 Botrel
6,772,840 B2 * 8/2004 Headworth ..... 166/302
6,774,276 B1 8/2004 Lund et al.
6,776,188 B1 * 8/2004 Rajewski ..... 137/624.13
6,782,950 B2 8/2004 Amin et al.
6,840,088 B2 1/2005 Tucker et al.
6,867,262 B1 3/2005 Angel et al.
6,880,640 B2 4/2005 Barratt et al.
6,957,146 B1 10/2005 Taner et al.
6,988,550 B2 1/2006 Bragg et al.
7,008,466 B2 3/2006 Collins
7,032,658 B2 4/2006 Chitwood et al.
7,044,226 B2 * 5/2006 Stave ..... 166/312
7,093,661 B2 8/2006 Olsen
7,121,339 B2 10/2006 Bragg et al.
7,152,682 B2 * 12/2006 Hopper ..... 166/357
7,183,240 B2 2/2007 Dahlmann et al.
7,225,078 B2 5/2007 Shelley et al.
7,225,877 B2 6/2007 Yater
7,253,138 B2 8/2007 Dahlmann et al.
7,261,810 B2 8/2007 Argo et al.
7,264,653 B2 9/2007 Panchalingam et al.
7,281,844 B2 10/2007 Glanville
7,397,976 B2 7/2008 Mendez et al.
7,406,738 B2 8/2008 Kinnari et al.
7,426,963 B2 9/2008 O'Neill
7,511,180 B2 3/2009 Waycuilis
7,530,398 B2 * 5/2009 Balkanyi et al. ..... 166/344
7,541,009 B2 6/2009 Takao et al.
7,585,816 B2 9/2009 Colle et al.
7,597,148 B2 * 10/2009 O'Malley et al. ..... 166/304
7,611,683 B2 11/2009 Grund et al.
7,615,516 B2 11/2009 Yang et al.
7,669,659 B1 * 3/2010 Lugo ..... 166/345
7,696,393 B2 4/2010 Rivers et al.
7,703,535 B2 * 4/2010 Benson ..... 166/368
7,708,839 B2 5/2010 Yemington
7,721,807 B2 * 5/2010 Stoisits et al. ..... 166/366
7,812,203 B2 10/2010 Balczewski
7,856,848 B2 12/2010 Lu
7,918,283 B2 * 4/2011 Balkanyi et al. ..... 166/344
7,947,857 B2 5/2011 Nazari et al.
7,958,939 B2 6/2011 Talley
7,964,150 B2 6/2011 Balczewski
7,994,374 B2 8/2011 Talley et al.
8,008,533 B2 8/2011 Argo et al.
8,034,748 B2 10/2011 Dahlmann et al.
8,047,296 B2 11/2011 Tian et al.
2003/0056954 A1 * 3/2003 Headworth ..... 166/302
2004/0133531 A1 7/2004 Chen et al.
2004/0143145 A1 7/2004 Servio et al.
2004/0149445 A1 * 8/2004 Appleford et al. ..... 166/357
2004/0176650 A1 9/2004 Lund et al.
2005/0137432 A1 6/2005 Matthews et al.
2005/0205261 A1 9/2005 Andersen et al.
2005/0256281 A1 11/2005 Grund et al.
2005/0283927 A1 12/2005 Kinnari et al.
2006/0009363 A1 1/2006 Crews
2006/0058449 A1 3/2006 Angel et al.
2006/0084581 A1 4/2006 Bragg et al.
2006/0106265 A1 * 5/2006 Rivers et al. ..... 585/15
2006/0144595 A1 7/2006 Milligan et al.
2006/0165344 A1 7/2006 Mendez et al.
2006/0175062 A1 8/2006 Benson
2006/0186023 A1 8/2006 Balkanyi et al.
2006/0218852 A1 10/2006 Graham
2006/0219412 A1 10/2006 Yater
2006/0254766 A1 11/2006 Richard et al.
2006/0268660 A1 11/2006 Glanville
2006/0272805 A1 12/2006 O'Malley et al.
2007/0003371 A1 1/2007 Yemington
2007/0157985 A1 * 7/2007 Caro et al. ..... 138/40
2007/0276169 A1 11/2007 Tohidi et al.
2008/0016909 A1 1/2008 Lu
2008/0023071 A1 1/2008 Smith et al.
2008/0053659 A1 * 3/2008 Kinnari et al. ..... 166/367
2008/0064611 A1 3/2008 Spratt
2008/0093081 A1 4/2008 Stoisits et al.

| | | | |
|---|---|---|---|
| 2008/0101999 | A1 | 5/2008 | Balczewski |
| 2008/0102000 | A1 | 5/2008 | Balczewski |
| 2008/0103343 | A1 | 5/2008 | Balczewski |
| 2008/0312478 | A1 | 12/2008 | Talley et al. |
| 2009/0054733 | A1 | 2/2009 | Marescaux et al. |
| 2009/0062579 | A1 | 3/2009 | Nazari et al. |
| 2009/0078406 | A1 | 3/2009 | Talley et al. |
| 2009/0124520 | A1 | 5/2009 | Tohidi |
| 2009/0221451 | A1 | 9/2009 | Talley |
| 2009/0230025 | A1 | 9/2009 | Argo et al. |
| 2009/0235850 | A1 | 9/2009 | Caro et al. |
| 2010/0012325 | A1 | 1/2010 | Friedemann |
| 2010/0018712 | A1 | 1/2010 | Tian et al. |
| 2010/0099807 | A1 | 4/2010 | Carlise et al. |
| 2010/0099814 | A1 | 4/2010 | Conrad et al. |
| 2010/0145115 | A1 | 6/2010 | Lund et al. |
| 2010/0180952 | A1 | 7/2010 | Verhelst et al. |
| 2010/0193194 | A1 | 8/2010 | Stoisits et al. |
| 2010/0236634 | A1 | 9/2010 | Nuland et al. |
| 2011/0220352 | A1 | 9/2011 | Lund et al. |
| 2011/0308625 | A1 | 12/2011 | Stoisits et al. |

FOREIGN PATENT DOCUMENTS

| | | | |
|---|---|---|---|
| EP | 0526929 | | 1/1996 |
| EP | 0566394 | | 6/1996 |
| EP | 1159238 | | 8/2008 |
| EP | 1957856 | | 3/2009 |
| GB | 2196716 | A | 5/1988 |
| JP | 2004/182885 | | 12/2002 |
| JP | 2004/197006 | | 12/2002 |
| JP | 2003/041271 | | 2/2003 |
| JP | 2003/055676 | | 2/2003 |
| JP | 2004/346184 | | 5/2003 |
| JP | 2005/008347 | | 1/2005 |
| OA | WO2007/095399 | | 8/2007 |
| WO | WO93/25798 | | 12/1993 |
| WO | WO95/17579 | | 6/1995 |
| WO | WO96/34177 | | 10/1996 |
| WO | WO98/17941 | | 4/1998 |
| WO | WO99/13197 | | 3/1999 |
| WO | WO00/25062 | | 5/2000 |
| WO | WO 01/25593 | A1 | 4/2001 |
| WO | WO 02/25060 | A1 | 3/2002 |
| WO | WO2004/063314 | | 7/2004 |
| WO | WO2005/026291 | | 3/2005 |
| WO | WO2005/058450 | | 6/2005 |
| WO | WO2006/027609 | | 3/2006 |
| WO | WO2006/048666 | | 5/2006 |
| WO | WO2006/052455 | | 5/2006 |
| WO | WO2006/054076 | | 5/2006 |
| WO | WO2006/068929 | | 6/2006 |
| WO | WO2007/025062 | | 3/2007 |
| WO | WO2008/023979 | | 2/2008 |
| WO | WO2009/008737 | | 1/2009 |
| WO | WO 2009/042307 | A1 | 4/2009 |
| WO | WO2009/054733 | | 4/2009 |
| WO | WO2010/083095 | | 7/2010 |
| WO | WO2011/062720 | | 5/2011 |
| WO | WO2011/062793 | | 5/2011 |
| WO | WO2011/109118 | | 9/2011 |

OTHER PUBLICATIONS

Freer, E. M. et al. (2001) "Methane Hydrate Film Growth Kinetics," *Fluid Phase Equilibria, Elsevier Science B.V.*, vol. 185, pp. 65-75.

Fu, Bob (2006) "Recent Advances in Hydrate Control Technologies With Emphasis on LDHI," *EniTecnologie Conference*Feb. 23, 2006, 36 pages.

Gnanendran, N. et al. (2004) "Modelling Hydrate Formation Kinetics of a Hydrate PromoterWater-Natural Gas System in a Semi-Batch Spray Reactor," *Chemical Engineering Science, Elsevier Science B.V.*, vol. 59, No. 18, pp. 3849-3863 (ISSN 00092509).

Grace, C. D. (1971) "Static Mixing and Heat Transfer," *Chemical and Processing Engineerin*, pp. 57-59.

Hemmingson, P. V. et al. (2008) "Hydrate Plugging Potential in Underinhibited Systems", *Proc. of the 6th ICGH, Vancouver, Canada*.

Ida, Hiroyuki et al. (2004) "Highly Efficient Natural Gas Hydrate Production Technology," *JFE Giho*, vol. 6 pp. 76-80 (ISSN 13480669).

Ilahi, M. (2005) "Evaluation of Cold Flow Concepts," *Masters Thesis, Norwegian Univ. of Sci. And Tech.*, Jun. 2005, 123 pages.

Johnson, T. et al. (2005) "Looking for Hydrates in Places Other Than Flowlines and Pipelines," *OTC 17345, 2005 Offshore Tech. Conf, Houston, TX May 2-5, 2005*, 4 pages.

Larsen, R. et al. (2001) "Conversion of Water to Hydrate Particles," *SPE 71550, New Orleans, LA*, 5 pages.

Lee, J. D. et al. (2005) "Methane-Ethane and Methane-Propane Hydrate Formation and Decomposition on Water Droplets," *Chemical Engineering Science, Elsevier Science B.V.*, vol. 60, No. 15, pp. 4203-4212 (ISSN 00092509).

Li, K. N. et al. (2005) "Experimental Research on the Influence of Jet Pump on the Cooling Storage Property of Gas Hydrates," *Int'l Journal of Modern Physics B*, v. 19. No. 1, 2 & 3, pp. 507-509.

Mork, M. et al. (2001) "Rate of Hydrate Formation in Subsea Pipelines, Correlation Based on Reactor Experiments," *12th Int'l Oil Field Chem. Symp., Geilo, Norway*, 11 pages.

Rogers, R. et al. (2006) "Gas Hydrate Storage of Natural Gas," *DOE#DE-FC26-01NT41297*, Jul. 13, 2006, 79 pages.

Sloan, E. D. (1997) "Gas Hydrate Tutorial," *Preprints-Meeting of the ACS Division of Fuel Chemistry*, vol. 42, No. 2, pp. 449-456 (American Chemical Society, 1997).

Tajima, H. et al. (2004) "Continuous Formation of $CO_2$ Hydrate via a Kenics-Type Static Mixer," *Energy & Fuels*, vol. 18, pp. 1451-1456.

Tajima, H. et al. (2005) "Continuous Formation of Gas Hydrate by Static Mixing," *Preprints-American Chemical Society-Div. of Petroleum Chemistry*, vol. 50, No. 1, pp. 4-5 (ISSN 05693799).

Tajima, H. et al. (2005) "Continuous Gas Hydrate Formation Process by Static Mixing of Fluids," *5th Int'l Conf. on Gas Hydrates, Trondheim, Norway, Paper #1010*, Jun. 13-16, 5 pages.

Talley, L. et al. (1999) "First Low Dosage Hydrate Inhibitor is Field Proven in Deepwater," *Pipeline and Gas Journal*, vol. 44, p. 226.

Talley, L. et al. (2001) "Comparison of Laboratory Results on Hydrate Induction Rates in a THF Rig, High-Pressure Rocking Cell, Miniloop, and Large Flowloop," *Gas Hydrates, Challenges for the Future: Annals of the New York Academy of Sciences*, vol. 912, pp. 314-321.

Urdahl, O. et al. (1997) "Experimental Testing and Evaluation of a Kinetic Gas Hydrate Inhibitor in Different Fluid Systems," *Preprints-Meeting of the ACS Div. of Fuel Chemistr*, vol. 42, pp. 498-502.

Valberg, T. (2006) "Efficiency of Thermodynamic Inhibitors for Melting Gas Hydrates," *Master's Thesis, Norwegian University of Science and Technology*, Trondheim, Norway.

Xie, Y. et al. (2005) "Gas Hydrate Fast Nucleation from Melting Ice and Quiescent Growth Along Vertical Heat Transfer Tube," *Science in China, Series B*, vol. 48, No. 1, pp. 75-82 (ISSN 10069291).

* cited by examiner

METHOD FOR MANAGING HYDRATES IN SUBSEA PRODUCTION LINE

CROSS REFERENCE TO RELATED APPLICATIONS

This application is the National Stage of International Application No. PCT/US2008/073891, filed Aug. 21, 2008, which claims the benefit of U.S. Provisional Application No. 60/995,134, filed Sep. 25, 2007.

BACKGROUND OF THE INVENTION

1. Field of the Invention

Embodiments of the present invention generally relate to the field of subsea production operations. Embodiments of the present invention further pertain to methods for managing hydrate formation in subsea production equipment such as a flowline.

2. Background of the Invention

More than two-thirds of the Earth is covered by oceans. As the petroleum industry continues its search for hydrocarbons, it is finding that more and more of the untapped hydrocarbon reservoirs are located beneath the oceans. Such reservoirs are referred to as "offshore" reservoirs.

A typical system used to produce hydrocarbons from offshore reservoirs uses hydrocarbon-producing wells located on the ocean floor. The producing wells are referred to as "producers" or "subsea production wells." The produced hydrocarbons are transported to a host production facility. The production facility is located on the surface of the ocean or immediately on-shore.

The producing wells are in fluid communication with the host production facility via a system of pipes that transport the hydrocarbons from the subsea wells on the ocean floor to the host production facility. This system of pipes typically comprises a collection of jumpers, flowlines and risers. Jumpers are typically referred to in the industry as the portion of pipes that lie on the floor of the body of water. They connect the individual wellheads to a central manifold. The flowline also lies on the marine floor, and transports production fluids from the manifold to a riser. The riser refers to the portion of a production line that extends from the seabed, through the water column, and to the host production facility. In many instances, the top of the riser is supported by a floating buoy, which then connects to a flexible hose for delivering production fluids from the riser to the production facility.

The drilling and maintenance of remote offshore wells is expensive. In an effort to reduce drilling and maintenance expenses, remote offshore wells are oftentimes drilled in clusters. A grouping of wells in a clustered subsea arrangement is sometimes referred to as a "subsea well-site." A subsea well-site typically includes producing wells completed for production at one and oftentimes more "pay zones." In addition, a well-site will oftentimes include one or more injection wells to aid in maintaining in-situ pressure for water drive and gas expansion drive reservoirs.

The grouping of remote subsea wells facilitates the gathering of production fluids into a local production manifold. Fluids from the clustered wells are delivered to the manifold through the jumpers. From the manifold, production fluids may be delivered together to the host production facility through the flowline and the riser. For well-sites that are in deeper waters, the gathering facility is typically a floating production storage and offloading vessel, or "FPSO." The FPSO serves as a gathering and separating facility.

One challenge facing offshore production operations is flow assurance. During production, the produced fluids will typically comprise a mixture of crude oil, water, light hydrocarbon gases (such as methane), and other gases such as hydrogen sulfide and carbon dioxide. In some instances, solid materials such as sand may be mixed with the fluids. The solid materials entrained in the produced fluids may typically be deposited during "shut-ins," i.e. production stoppages, and require removal.

Of equal concern, changes in temperature, pressure and/or chemical composition along the pipes may cause the deposition of other materials such as methane hydrates, waxes or scales on the internal surface of the flowlines and risers. These deposits need to be periodically removed, as build-up of these materials can reduce line size and constrict flow.

Hydrates are crystals formed by water in contact with natural gases and associated liquids, in a ratio of 85 mole % water to 15% hydrocarbons. Hydrates can form when hydrocarbons and water are present at the right temperature and pressure, such as in wells, flow lines, or valves. The hydrocarbons become encaged in ice-like solids which do not flow, but which rapidly grow and agglomerate to sizes which can block flow lines. Hydrate formation most typically occurs in subsea production lines which are at relatively low temperatures and elevated pressures.

The low temperatures and high pressures of a deepwater environment cause hydrate formation as a function of gas-to-water composition. In a subsea pipeline, hydrate masses usually form at the hydrocarbon-water interface, and accumulate as flow pushes them downstream. The resulting porous hydrate plugs have the unusual ability to transmit some degree of gas pressure, while acting as a flow hindrance to liquid. Both gas and liquid may sometimes be transmitted through the plug; however, lower viscosity and surface tension favors the flow of gas.

It is desirable to maintain flow assurance between cleanings by minimizing hydrate formation. One offshore tool used for hydrate plug removal is the depressurization of the pipeline system. Traditionally, depressurization is most effective in the presence of lower water cuts. However, the depressurization process sometimes prevents normal production for several weeks. At higher water cuts, gas lift procedures may be required. Further, hydrates may quickly re-form when the well is placed back on line.

Most known deepwater subsea pipeline arrangements rely on two production lines for hydrate management. In the event of an unplanned shutdown, production fluid in the production flowline and riser is displaced with dehydrated dead crude oil using a pig. Displacement is completed before the production fluids (which are typically untreated or "uninhibited") cool down below the hydrate formation temperature. This prevents the creation of a hydrate blockage in the production lines. The pig is launched into one production line, is driven with the dehydrated dead crude out to the production manifold, and is forced back to the host facility through the second production line.

The two-production-line operation is feasible for large installations. However, for relatively small developments the cost of a second production line can be prohibitive.

It is also known to use methanol or other suitable hydrate inhibitor in connection with a hydrate management operation. In this respect, a large quantity of methanol may be pumped into the production line ahead of the displacement fluid and the pig. Displacing methanol out of the service line and into the production line ahead of the displacement fluid helps to ensure that any uninhibited production fluid in the production line that is not displaced out of the line will be inhibited by methanol. However, this procedure generally requires that large quantities of methanol be stored on the production facility. An improved process of hydrate management is needed.

Other relevant information may be found in: U.S. Pat. Nos. 6,152,993; 6,015,929; 6,025,302; 6,214,091; commonly assigned International Patent Application Publication No. WO 2006/031335 filed on Aug. 11, 2005; U.S. application Ser. No. 11/660,777; and U.S. Provisional Patent Application No. 60/995,161.

SUMMARY OF THE INVENTION

A method for managing hydrates in a subsea production system is provided. The system has a production facility, a control umbilical for delivering displacement fluids from the production facility, at least one subsea production well, and a single production line for delivering produced fluids to the production facility. The method includes producing hydrocarbon fluids from the at least one subsea production well and through the single production line, and then shutting in the flow of produced fluids from the subsea well and the production line. The method also includes depressurizing the production line to substantially reduce a solution gas concentration in the produced hydrocarbon fluids, and then repressurizing the production line to urge any gas remaining in a free-gas phase within the production line back into solution. The step of repressurizing the production line preferably is accomplished by pumping the displacement fluid into the control umbilical and into the production line. In addition, the method includes displacing production fluids within the production line. This may be done by moving the displacement fluids from a service line within the umbilical line, and into the production line.

The displacement fluids preferably comprise a hydrocarbon-based fluid having a low dosage hydrate inhibitor (LDHI). In one aspect, the displacement fluid is substantially without light hydrocarbon gases. Preferably, the displacement fluid comprises dead crude, diesel, or combinations thereof, along with the LDHI inhibitor. Preferably, the displacement fluid is injected into a service line in the control umbilical.

The step of displacing production fluids may comprise injecting the displacement fluid into the service line at a maximum allowable rate for the service line. For example, the step of displacing production fluids may comprise injecting the displacement fluid into the service line at a rate of 5,000 to 9,000 bpd. In any respect, the step of displacing production fluids may be performed without the use of a pig ahead of the displacement fluid.

In one aspect, the LDHI is a kinetic hydrate inhibitor. Nonlimiting examples include polyvinylcaprolactam and polyisopropylmethacrylamide. In another aspect, the LDHI is an anti-agglomerant. Nonlimiting examples include tributylhexadecylphosphonium bromide, tributylhexadecylammonium bromide, and di-butyl di-dodecylammonium bromide.

The method may further include the step of monitoring the production fluids as they are displaced from the production line to evaluate water content and gas phase. Alternatively, or in addition, the method may include further displacing the production fluids from the production line to urge production fluids from the production line to the production facility until substantially all water content has been removed. Further still, the method may include further displacing the production fluids from the production line to urge substantially all of the production fluids from the production line to the production facility, leaving the production line full of displacement fluids and LDHI.

Certain of the steps may be repeated. For example, the method may further include repeating the depressurizing step, repeating the repressurizing step, and repeating the displacing step. Whether or not these steps are repeated, the method may further comprise producing hydrocarbon fluids after the displacement fluid has been pumped through the production line. The flow of produced fluids is thus re-initiated from the subsea well, through the single production line, and to the production facility. Thereafter, the produced fluids may be transported to shore.

It is understood that the production facility may be of any type. For example, the production facility may be a floating production, storage and offloading vessel ("FPSO"). Alternatively, the production facility may be a ship-shaped gathering vessel or a production facility that is near shore or onshore.

It is also understood that the subsea production system may include other components. For example, the subsea production system may have a manifold and an umbilical termination assembly. The manifold provides a subsea gathering point for production fluids, while the umbilical termination assembly provides a subsea connection for injection chemicals. The control umbilical may comprise a first umbilical portion that connects the production facility with the umbilical termination assembly, and a second umbilical portion that connects the umbilical termination assembly with the manifold.

BRIEF DESCRIPTION OF THE DRAWINGS

So that the manner in which the features of the present invention can be better understood, certain drawings, charts and diagrams are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
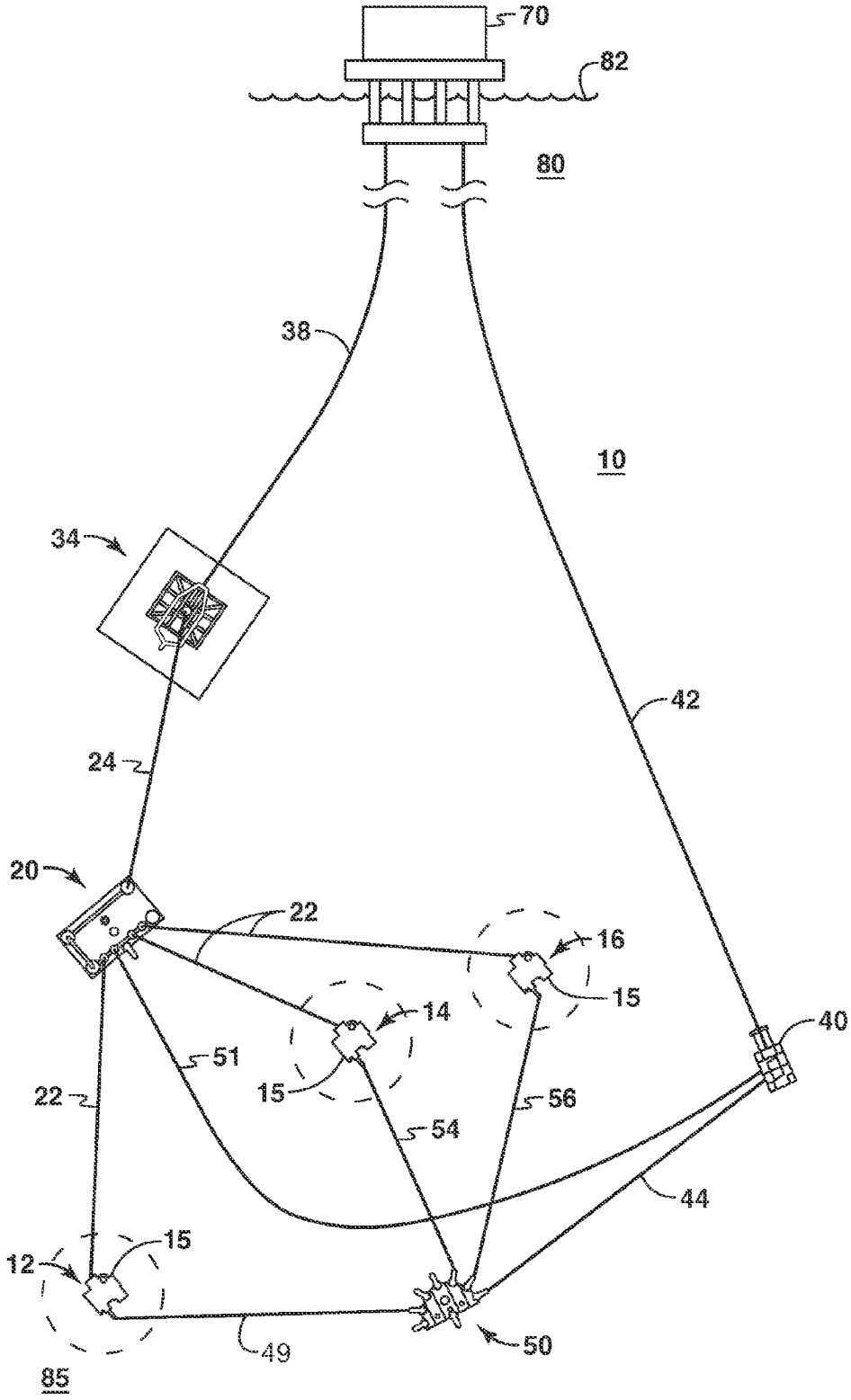
FIG. 1 is a perspective view of a subsea production system utilizing a single production line and a utility umbilical line. The system is in production.

As used herein, the term "displacement fluid" refers to a fluid used to displace another fluid. Preferably, the displacement fluid has no hydrocarbon gases. Non-limiting examples include dead crude and diesel.

The term "umbilical" refers to any line that contains a collection of smaller lines, including at least one service line for delivering a working fluid. The "umbilical" may also be referred to as an umbilical line or umbilical cable. The working fluid may be a chemical treatment such as a hydrate inhibitor or a displacement fluid. The umbilical will typically include additional lines, such as hydraulic power lines and electrical power cables.

The term "service line" refers to any tubing within an umbilical. The service line is sometimes referred to as an umbilical service line, or USL. One example of a service line is an injection tubing used to inject a chemical.

The term "low dosage hydrate inhibitor," or "LDHI," refers to both anti-agglomerants and kinetic hydrate inhibitors. It is intended to encompass any non-thermodynamic hydrate inhibitor.

The term "production facility" means any facility for receiving produced hydrocarbons. The production facility may be a ship-shaped vessel located over a subsea well site, an FPSO vessel (floating production, storage and offloading vessel) located over or near a subsea well site, a near-shore separation facility, or an onshore separation facility. Synonymous terms include "host production facility" or "gathering facility."

The terms "tieback," "tieback line," and "riser" and "production line" are used interchangeably herein, and are intended to be synonymous. These terms mean any tubular structure or collection of lines for transporting produced hydrocarbons to a production facility. A production line may include, for example, a riser, flowlines, spools, and topside hoses.

The term "production line" means a riser and any other pipeline used to transport production fluids to a production facility. The production line may include, for example, a subsea production line and a flexible jumper.

"Subsea production system" means an assembly of production equipment placed in a marine body. The marine body may be an ocean environment, or it may be, for example, a fresh water lake. Similarly, "subsea" includes both an ocean body and a deepwater lake.

"Subsea equipment" means any item of equipment placed proximate the bottom of a marine body as part of a subsea production system.

"Subsea well" means a well that has a tree proximate the marine body bottom, such as an ocean bottom. "Subsea tree," in turn, means any collection of valves disposed over a wellhead in a water body.

"Manifold" means any item of subsea equipment that gathers produced fluids from one or more subsea trees, and delivers those fluids to a production line, either directly or through a jumper line.

"Inhibited" means that produced fluids have been mixed with or otherwise been exposed to a chemical inhibitor for inhibiting formation of gas hydrates including natural gas hydrates. Conversely, "uninhibited" means that produced fluids have not been mixed with or otherwise been exposed to a chemical inhibitor for inhibiting formation of gas hydrates.

Description of Selected Specific Embodiments

FIG. 1 provides a perspective view of a subsea production system 10 which may be used to produce hydrocarbons from a subterranean offshore reservoir. The system 10 utilizes a single production line, including a riser 38. Oil, gas and, typically, water, referred to as production fluids, are produced through the production riser 38. In the illustrative system 10, the production riser 38 is an 8-inch insulated production line. However, other sizes may be used. Thermal insulation is provided for the production riser 38 to maintain warmer temperatures for the production fluids and to inhibit hydrate formation during production. Preferably, the production flowline protects against hydrate formation during a minimum of 20 hours of cool-down time during shut-in conditions.

The production system 10 includes one or more subsea wells. In this arrangement, three wells 12, 14 and 16 are shown. The wells 12, 14, 16 may include at least one injection well and at least one production well. In the illustrative system 10, wells 12, 14, 16 are all producers, thereby forming a production cluster.

Each of the wells 12, 14, 16 has a subsea tree 15 on a marine floor 85. The trees 15 deliver production fluids to a jumper 22, or short flowline. The jumpers 22 deliver production fluids from the production wells 12, 14, 16 to a manifold 20. The manifold 20 is an item of subsurface equipment comprised of valves and piping in order to collect and distribute fluid. Fluids produced from the production wells 12, 14, 16 are usually comingled at the manifold 20, and exported from the well-site through a subsea flowline 24 and the riser 38. Together, the flowline 24 and the riser 38 provide a single production line.

The production riser 38 ties back to a production facility 70. The production facility, also referred to as a "host facility" or a "gathering facility," is any facility where production fluids are collected. The production facility may, for example, be a ship-shaped vessel capable of self-propulsion in the ocean. The production facility may alternatively be fixed to land and reside near shore or immediately on-shore. However, in the illustrative system 10, the production facility 70 is a floating production, storage and offloading vessel (FPSO) moored in the ocean. The FPSO 70 is shown positioned in a marine body 80, such as an ocean, having a surface 82 and a marine floor 85. In one aspect, the FPSO 70 is 3 to 15 kilometers from the manifold 20.

In the arrangement of FIG. 1, a production sled 34 is used. The optional production sled 34 connects the production flowline 38 with the riser 38. A flexible hose (not seen in FIG. 1) may be used to facilitate the communication of fluid between the riser 38 and the FPSO 70.

The subsea production system 10 also includes a utility umbilical 42. The utility umbilical 42 represents an integrated electrical/hydraulic control line. Utility umbilical line 42 typically includes conductive wires for providing power to subsea equipment. A control line within the umbilical 42 may carry hydraulic fluid used for controlling items of subsea equipment such as a subsea distribution unit ("SDU") 50, manifolds 20, and trees 15. Such control lines allow for the actuation of valves, chokes, downhole safety valves, and other subsea components from the surface. Utility umbilical 42 also includes a chemical injection tubing or service line which transmits chemical inhibitors to the ocean floor, and then to equipment of the subsea production system 10. The inhibitors are designed and provided in order to ensure that flow from the wells is not affected by the formation of solids in the flow stream such as hydrates, waxes and scale. Thus, the umbilical 42 will typically contain a number of lines bundled together to provide electrical power, control, hydraulic power, fiber optics communication, chemical transportation, or other functionalities.

The utility umbilical 42 connects subsea to an umbilical termination assembly ("UTA") 40. From the umbilical termination assembly 40, umbilical line 44 is provided, and connects to a subsea distribution unit ("SDU") 50. From the SDU 50, flying leads 49, 54, 56 connect to the individual wells 12, 14, 16, respectively.

In addition to these lines, a separate umbilical line 51 may be directed from the UTA 40 directly to the manifold 20. A chemical injection service line (not seen in FIG. 1) is placed in both of service umbilical lines 42 and 51. The service line is sized for the pumping of a fluid inhibitor followed by a displacement fluid. During shut-in, and during a hydrate management operation, the displacement fluid is pumped through the chemical tubing, through the manifold 20, and into the production riser 38 in order to displace produced hydrocarbon fluids before hydrate formation begins.

The displacing fluids may be dehydrated and degassed crude oil. Alternatively, the displacing fluids may be diesel. In either instance, an additional option is to inject a traditional chemical inhibitor such as methanol, glycol or MEG before the displacement fluid. However, this is not preferred due to the large quantity required.

It is understood that the architecture of system 10 shown in FIG. 1 is illustrative. Other features may be employed for producing hydrocarbons from a subsea reservoir and for inhibiting the formation of hydrates. For example, a valve (shown at 37 in FIG. 3) may be placed in-line between the chemical tubing and the manifold 20 to provide selective fluid communication with the production riser 38. The system 10 may further include a water injection line (not shown) in some embodiments.

Figure 2:
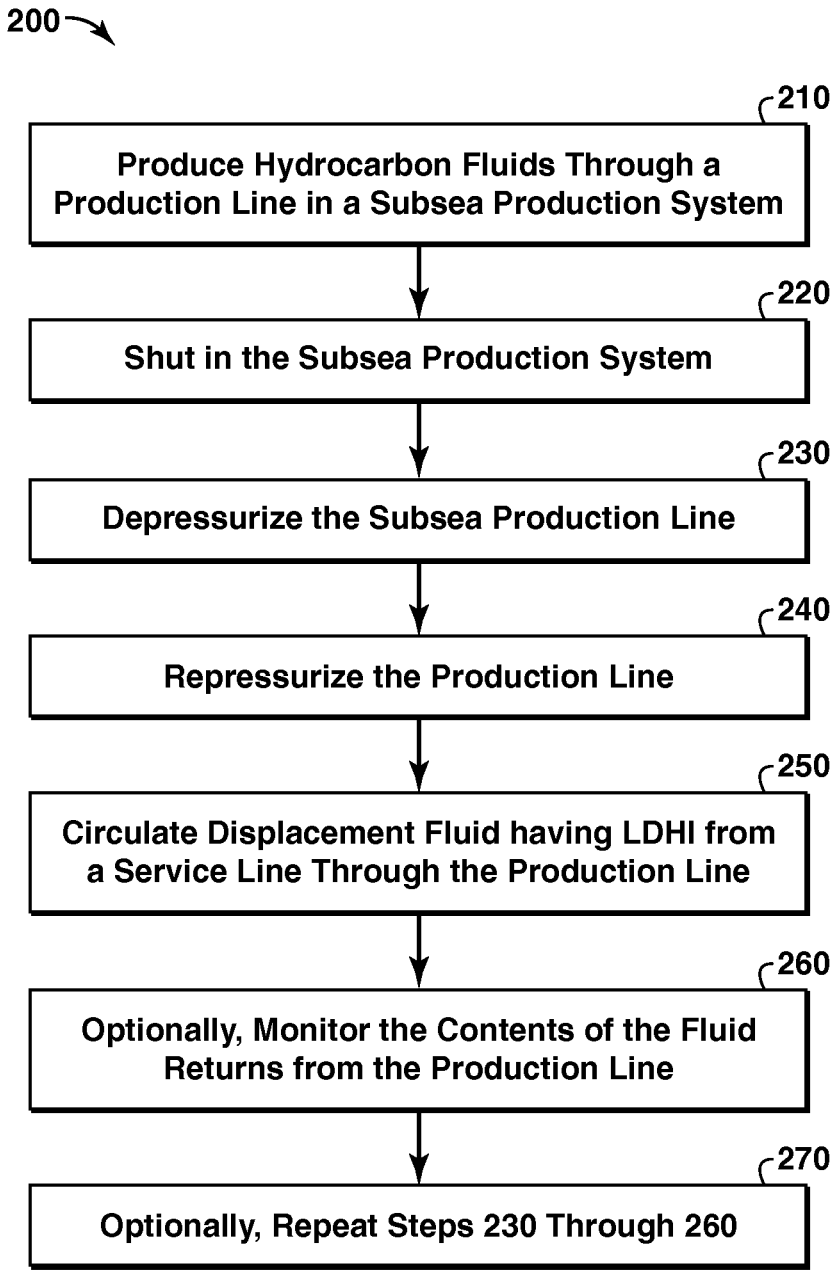
FIG. 2 is a flowchart demonstrating steps for performing the hydrate management process of the present invention, in one embodiment.

FIG. 2 is a flowchart demonstrating steps for performing a hydrate management process 200 of the present invention, in one embodiment. The method 200 employs a subsea production system, such as system 10 of FIG. 1. The system 10 includes a host production facility, an umbilical line, a manifold, at least one subsea production well, and a single production line. The method 200 enables displacement of production fluids from the single production line via an injection tubing within the umbilical line. Preferably this is done without the use of a thermodynamic hydrate inhibitor such as methanol.

In one embodiment, the method 200 first includes the step of producing hydrocarbon fluids through the production line. The production step is represented by Box 210. The method 200 is not limited as to the production rate, the hydrocarbon fluid composition, or any offshore operating parameters.

The method 200 also includes the step of shutting in the production system 220. This means that hydrocarbon fluids are no longer being produced from the subsea production wells. Any fluids already produced and residing in the production line are held in the production line. The shut-in may be either planned or unplanned. For example, an unplanned shut-in may occur where there is a subsea leak in a flowline or in a jumper connection. An unplanned shut-in may also occur where there is a failure in a separator or other equipment on the production facility.

The method 200 next includes depressurizing the subsea production system. More specifically, the method includes depressurizing the production line in the system. This depressurizing step is represented by Box 230. In normal operating conditions, the production line will carry a pressure induced by formation pressure, countered by the hydrostatic head within the production line. Depressurizing the line means that the pressure is reduced to a level that is at or above the hydrostatic head, but less than operating pressure.

The purpose of the depressurizing step 230 is to significantly reduce the solution gas concentration in the produced hydrocarbon fluids. The depressurizing step may be accomplished by shutting in the wells and/or the production line, but continuing to produce hydrocarbon fluids. As production continues and the pressure drops, the production fluids will be more and more in the form of methane and other gas phase fluids. The gas breaking out of solution may be flared at the production facility, or stored for later use or commercial sale. Preferably, recovered gases are routed to a flare scrubber.

The method 200 next includes the step of repressurizing the subsea production system. More specifically, the method includes repressurizing the production line in the system. This repressurizing step is represented by Box 240. The step 240 of repressurizing the production line means that pressure is added to the production line to a level sufficient to urge any gas remaining in the free gas phase within the production line back into solution. Of course, gas that was not in solution before the depressurization step 230 generally will not go into solution in step 240.

The repressurizing step 240 may be accomplished by pumping displacement fluid into the service line in the utility umbilical. The displacement fluid moves toward the production line without the production line being open at the production facility. The amount of pressure required to perform step 240 depends on a variety of factors. Such factors include the temperature of the sea water and the composition of the hydrocarbon fluids. Such factors also include the geometry of the production line which represents the production flowline, the production riser, the production buoy, and any flexible hoses from the riser leading to the FPSO.

The displacement fluid that is used in step 240 preferably comprises dead crude, diesel, or other hydrocarbon-based fluid having little or no methane or other hydrocarbon gases. Preferably, the displacement fluid does not include methanol. However, the displacement fluid does include a low dosage hydrate inhibitor, or "LDHI." Low dosage hydrate inhibitors are defined as non-thermodynamic hydrate inhibitors. This means that the inhibitors do not lower the energy state of the free gas and water to the more ordered lowered energy state created by hydrate formation. Instead, such inhibitors interfere with the hydrate formation process by blocking the hydrate-growing site, thereby retarding the growth of hydrate crystals. LDHI's inhibit gas hydrate formation by coating and comingling with hydrate crystals, thereby interfering with the growth and the agglomeration of small hydrate particles into larger ones. As a result, plugging of the gas well and flowlines is minimized or eliminated.

Low dosage hydrate inhibitors may be categorized into two classes: (1) kinetic hydrate inhibitors ("KHI"), and (2) anti-agglomerants ("AA"). A KHI can prevent hydrate formation but generally does not dissolve already formed hydrates. An AA generally allows hydrates to form but keeps the hydrate particles dispersed in the fluids so they do not form plugs on the walls of a flow line. Because of their attributes, one may chose to use a combination of KHI and AA type of LDHI. Examples of KHI inhibitors include polyvinylpyrrolidone, polyvinylcaprolactam or a polyvinylpyrrolidone caprolactam dimethylaminoethylmethacrylate copolymer. Such inhibitors may contain a caprolactam ring attached to a polymeric backbone and copolymerized with esters, amides or polyethers. Another example of a suitable kinetic hydrate inhibitor is an aminated polyalkylene glycol of the formula: $R^1R^2N[(A)_a-(B)_b-(A)_c-(CH_2)_d—CH(R)—NR^1]_nR^2$ wherein:

each A is independently selected from $—CH_2CH(CH_3)O—$ or $—(CH_3)CH_2O—$;

B is $—CH_2CH_2O—$;

a+b+c is from 1 to about 100;

R is —H or $CH_3$;

each $R^1$ and $R^2$ is independently selected from the group consisting of —H, $—CH_3$, $—CH_2—CH_2—OH$ and $CH(CH_3)—CH_2—OH$;

d is from 1 to about 6; and n is from 1 to about 4.

For example, the kinetic hydrate inhibitor may be selected from the group consisting of:

(i) $R^1HN(CH_2CHRO)_j(CH_2CHR)$ (ii) $H_2N(CH_2CHRO)_a(CH_2CH_2O)_b(CH_2CHR)NH_2$; and (iii) mixtures thereof, wherein:

a+b is from 1 to about 100; and j is from 1 to about 100.

Preferably, each $R^1$ and $R^2$ is —H;

a, b, and c are independently selected from 0 or 1; and n is 1.

Examples of anti-agglomerants ("AA") are substituted quaternary compounds. Examples of quaternary compounds include quaternary ammonium salts having at least three alkyl groups with four or five carbon atoms and a long chain hydrocarbon group containing 8-20 atoms. Illustrative compositions include tributylhexadecylphosphonium bromide, tributylhexadecylammonium bromide, and di-butyl di-dodecylammonium bromide. Other anti-agglomerants are disclosed in U.S. Pat. Nos. 6,152,993; 6,015,929; and 6,025,302. Specifically, U.S. Pat. No. 6,015,929 describes various examples of hydrate anti-agglomerants such as sodium valerate, n-butanol, $C_4$-$C_8$ zwitterion, (zwitterionic head group with $C_4$-$C_8$ tail group), 1-butanesulfonic acid Na salt, butanesulfate Na salt, alkylpyrrolidones and mixtures thereof. U.S. Pat. No. 6,025,302 describes the use of ammonium salts of polyether amines as gas hydrate inhibitors.

Other examples of AA inhibitors include the di-ester of di-butyl-di-ethanol ammonium bromide and coconut fatty acid, the dicocoyl ester of di-butyl di-isopropanol ammonium bromide and the dicocoyl ester of dibutyl diisobutanol ammonium bromide are disclosed in U.S. Pat. No. 6,214,091.

In one aspect, the low dosage hydrate inhibitor ("LDHI") is mixed with water to form an aqueous solution (before mixture with dead crude). In one instance, the aqueous solution is between from about 0.01 to about 5% by weight of water. More preferably, the LDHI composition is from about 0.1 to about 2.0 percent by weight of water. The aqueous solution may be a brine having a density of 12.5 pounds/gallon (ppg) (or 1.5 g/cm$^3$) or less. Such brines are typically formulated with at least one salt selected from $NH_4Cl$, CsCl, CsBr, NaCl, NaBr, KCl, KBr, HCOONa, HCOOK, $CH_3COONa$, $CH_3COOK$, $CaCl_2$, $CaBr_2$, and $ZnBr_2$.

A small amount of a thermodynamic hydrate inhibitor may be mixed with a kinetic hydrate inhibitor to form a suitable inhibitor admixture. A thermodynamic hydrate inhibitor functions to lower the energy state or "chemical potential" of the free gas and water to a more ordered lowered energy state than that of the formed hydrate and thermodynamic hydrate inhibitor. Thus, the use of thermodynamic hydrate inhibitors in deepwater oil/gas wells having lower temperature and high-pressure conditions causes the formation of stronger bonds between the thermodynamic hydrate inhibitor and water versus gas and water. Known thermodynamic hydrate inhibitors include alcohol (e.g. methanol), glycol, polyglycol, glycol ether, or a mixture thereof. Preferably, the thermodynamic inhibitor is methanol or glycol.

The method 200 also includes the step of displacing production fluids from the production line. This displacement step is represented by Box 250. The production fluids primarily comprise live hydrocarbon fluids, including methane. In order to displace fluids, the displacement fluid continues to be pumped from the service line into the production line. The production line is opened at the production facility. The live hydrocarbon fluids are then received from the production line, followed by the displacement fluid.

Figure 3:
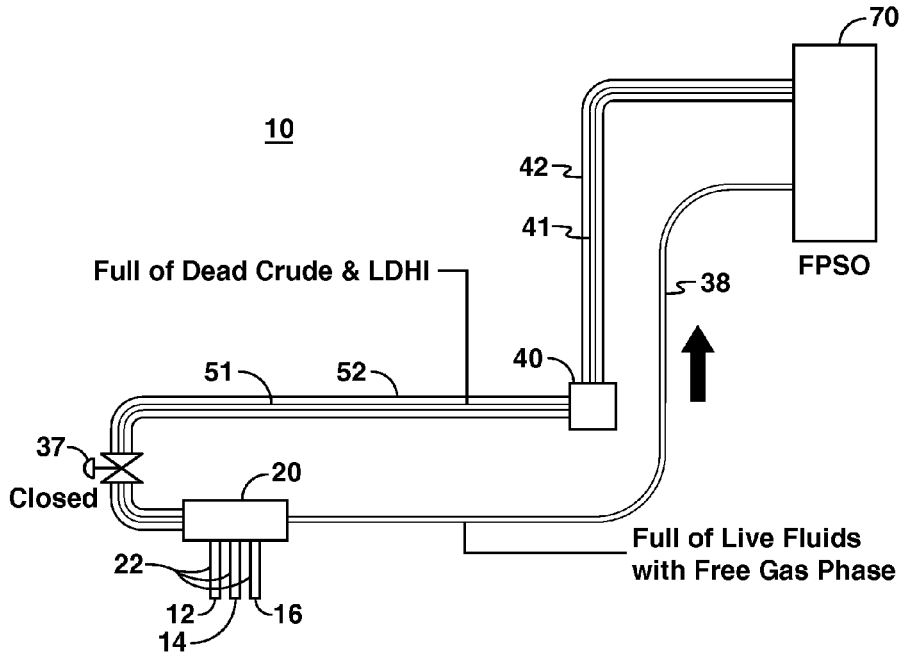
FIG. 3 is a partial schematic view of the subsea production system of FIG. 1. A utility umbilical and a production line are seen.
Figure 4:
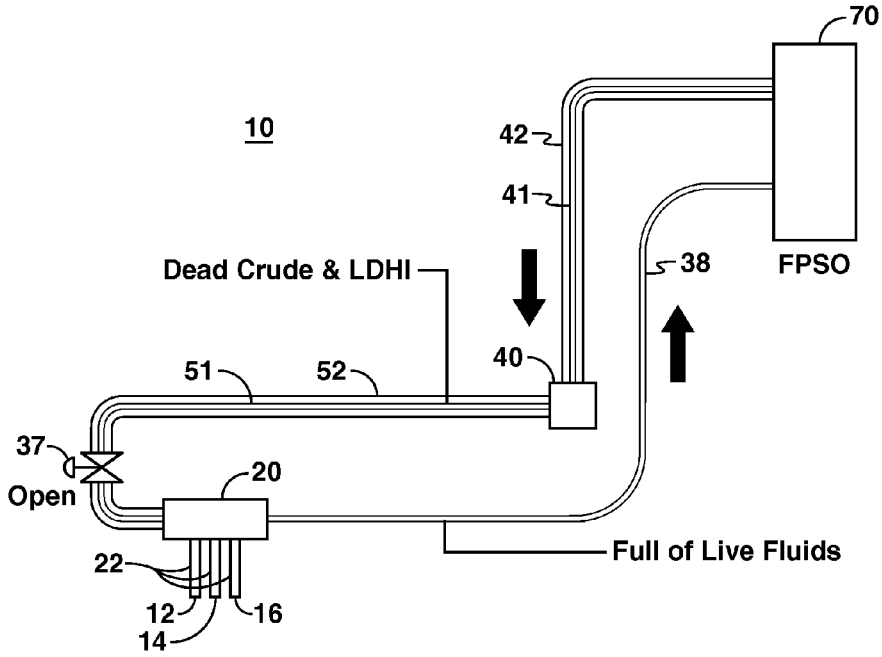
FIG. 4 is another schematic view of the production system of FIG. 1. The utility umbilical and the production line are again seen. The valve connecting the utility umbilical with the production line has been opened so that production fluids may be displaced.
Figure 5:
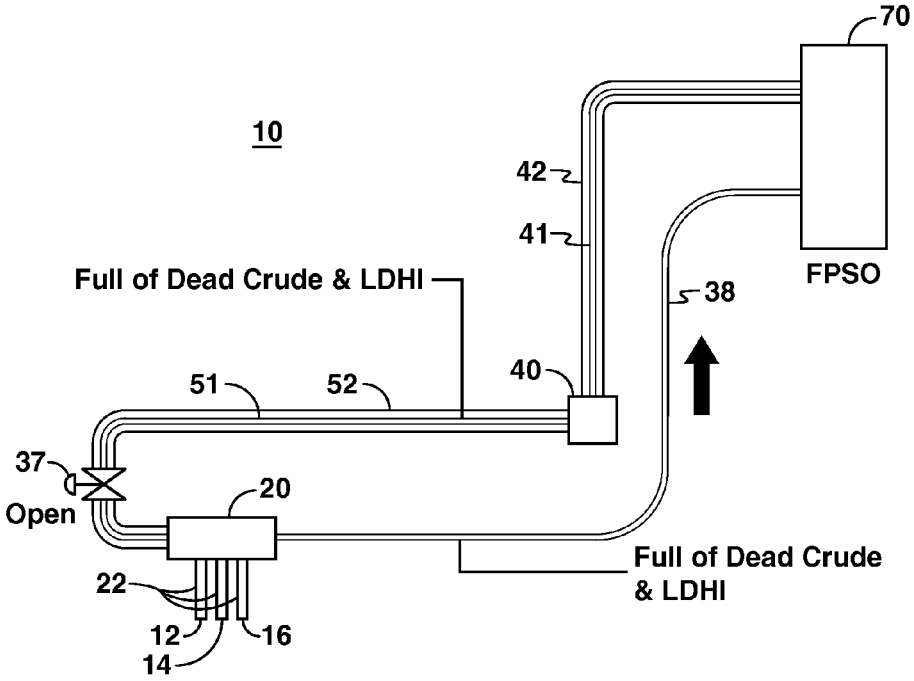
FIG. 5 is yet another schematic view of the production system of FIG. 1. The utility umbilical and the production line are again seen. The valve connecting the utility umbilical with the production line remains open. Production fluids have been substantially displaced.

The step of circulating displacement fluids with LDHI takes place by injecting the displacement fluid into the injection tubing within the utility umbilical. The process of displacement with dead crude and LDHI is described through FIGS. 3 through 5. FIGS. 3 through 5 provide partial schematic views of a subsea production system 10. In each figure, a schematic view of the subsea production system 10 from FIG. 1 is provided. In each view, a utility umbilical is provided. The utility umbilical represents both a primary umbilical line 42 and a manifold umbilical line 52. In the illustrative subsea production system 10, the umbilicals 42, 52 are connected to each other at a UTA 40. Together, the umbilicals 42, 52 extend from the FPSO 70 down to the production manifold 20. The subsea umbilical 52 is fluidly connected to the manifold 20, while the utility umbilical 42 preferably ties back to the FPSO 70.

The utility umbilicals 42, 52 each represent integrated umbilicals where control lines, conductive power lines, and/or chemical lines are bundled together for delivery of hydraulic fluid, electrical power, chemical inhibitors or other components to subsea equipment and lines. The bundled umbilical lines 42, 52 may be made up of thermoplastic hoses of various sizes and configurations. In one known arrangement, a nylon "Type 11" internal pressure sheath is utilized as the inner layer. A reinforcement layer is provided around the internal pressure sheath. A polyurethane outer sheath may be provided for water proofing. Where additional collapse resistance is needed, a stainless steel internal carcass may be disposed within the internal pressure sheath. An example of such an internal carcass is a spiral wound interlocked 316 stainless steel carcass.

Where colder temperatures and higher pressures are encountered, the umbilicals 42, 52 may be comprised of a collection of separate steel tubes bundled within a flexible vented plastic tube. The use of steel tubes, however, reduces line flexibility.

It is also understood that the methods of the present invention are not limited by any particular umbilical arrangements so long as the utility umbilicals 42, 52 each include a chemical injection tubing 41, 51 therein. Umbilical 52 could be umbilicals 54 or 56 from FIG. 1. The chemical injection tubings 41, 51 are sized to accommodate the pumping of a displacement fluid. In one embodiment, the chemical tubing 51 within the umbilical 52 is a 3-inch inner diameter line, and the chemical tubing 41 within the umbilical 42 is also a 3-inch inner diameter line. However, the umbilicals 52, 42 may have other diameters, such as about 2 to 4 inches.

The injection tubings 41, 51 serve to transmit a working fluid from the FPSO 70 to the manifold 20. During normal production, i.e., without shut-in, the injection tubings 41, 51 are filled with a displacement fluid such as a dead crude. Optionally, the injection tubings 41, 51 are filled with methanol or other chemical inhibitor before the displacement fluid is injected. This helps to prevent the formation of hydrates during cold start-up.

Referring now to the production riser 38, the production riser 38 connects to the manifold 20 at one end, and ties back to the FPSO 70 at the other end. An intermediate sled and jumper line (shown at 34 and 24, respectively, in FIG. 1) may be used. The production riser 38 may be, in one aspect, an 8-inch line. Alternatively, the production riser 38 may be a 10-inch line, a 12-inch line, or other sized line. Preferably, the production riser 38 is insulated with an outer and, possibly, an inner layer of thermally insulative material. The insulation is such that the production fluids retain heat and arrive at a separator on the FPSO 70 at a temperature that is higher than the hydrate formation temperature.

A valve 37 is provided at or near the junction between the subsea umbilical 52 and the manifold 20. The valve 37 allows selective fluid communication between the chemical tubing 41 within the umbilicals 42/52 and the manifold 20. It is understood that the valve 37 may be part of the manifold 20. However, the valve 37 is shown separately for illustrative purposes. It is also understood that the valve 37 is preferably controlled remotely, such as through electrical control signals and hydraulic fluid distributed from the bundled umbilical 52.

In one illustrative embodiment, the umbilical lines 42, 52 together are 10.3 km in length, while the production riser 38 is 10.5 km in length. A 3-inch ID chemical tubing of that length may receive 300 to 375 barrels of fluid. The 8-inch production line holds approximately 1,885 barrels of fluid. Of course, other lengths and diameters for the lines 38, 41, 42, 51, 52 may be provided.

Turning now specifically to FIG. 3, FIG. 3 provides a schematic view of the subsea production system during a state of production. The injection tubings 41, 51 are filled with a displacement fluid such as a dead crude containing a LDHI. The valve 37 is in a closed position to prevent the movement of displacement fluid from the injection line 51 to the production riser 38.

In FIG. 3, a flow of produced fluids from the producing wells 12, 14, 16 has taken place. The production fluids flow from the producers 12, 14, 16, through the production manifold, and into the production riser 38. This is in accordance with step 210 of method 200.

The production riser 38 is filled with live fluids." "Live fluids" means that the hydrocarbon fluids have a free gas phase. The fluids may be "uninhibited," meaning that they have not been treated with methanol, glycol or other hydrate inhibitor. At the same time, the 3-inch umbilical service lines (USL) 41, 51 hold a displacement fluid such as a dead crude or diesel. In one aspect, the USL lines 41, 51 are left full of roughly 275 bbl of dead crude inhibited with a LDHI.

In FIG. 3, the valve 37 is closed. This prevents the movement of displacement fluids into the production stream. It also allows the production riser 38 to be depressurized in accordance with step 220.

After the depressurization step 230, the valve 37 is opened in order to repressurize the production riser 38 in accordance with step 240. As noted, the purpose of the repressurization step 240 is to significantly reduce the free gas concentration in the produced oil. Pressure in the system 10 is increased by pumping displacement fluid into the injection tubing 51 in the umbilical 52. This will cause free gas to be displaced out of the production flowline 24 and the riser 38. The free gas remaining in the flowline 24 and riser 38 will be driven back into solution.

After depressurization 230 and then repressurization 240 of the system 10, dead crude and LDHI are pumped into the service riser 38 to displace the uninhibited depressurized/repressurized production fluids out of the production riser 38. This is preferably done without a pig separating the fluids. This is the circulation step 250, demonstrated in FIGS. 4 and 5.

FIG. 4 provides another schematic view of the production system 10. Here, valve 37 is opened and displacement fluid is being circulated into the production riser 38. The displacement fluid is displacing production fluids up to the FPSO 70. Displacement fluid will substantially displace production fluids from the production flowline 24 and production riser 38 until both the injection tubing 51 in the umbilical 52 and the production riser 38 are substantially filled with the displacement fluid. This is done without a pig separating the fluids. The circulation step 250 also serves to displace any remaining free gas in the production riser 38.

During displacement, the pump velocity should be high enough to create laminar flow within the production riser 38. For example, for a 10-inch line, a pump rate of 5,000 barrels per day should be adequate. Displacement at relatively low velocity without a pig is inefficient in that it allows significant mixing and bypassing of production fluids by the displacing fluid.

It is noted from FIGS. 3 and 4 that the production riser 38 runs "uphill" from the well manifold 20 to the FPSO 70. The only exception pertains to the use of a riser base spool, a flexible jumper low point (not shown), and possibly some bumps along the flowline due to ocean floor contour. Because of the gradient, when a well is shut in for an extended period of time, e.g., 4 or more hours, the produced fluids in the production riser 38 will largely segregate into layers of (1) water, (2) live oil and (3) gas, although variable terrain, emulsions or foaming may impede segregation. The behavior of the interfaces between these layers is noted as follows:

1. Live oil and gas interface. Due to the uphill geometry and the lower density of gas as compared to the live oil, most gas naturally flows towards the FPSO 70. Some gas is trapped at high points in the system 10. As pressure increases, the crude in the produced fluids may absorb the gas and transport it to the FPSO 70.

2. Water and live oil interface. Due to the uphill geometry and the lower density of live oil as compared to the water, most live oil naturally flows towards the FPSO 70.

3. Cold dead crude/production fluid interface. At an average rate of 5,000 bpd in a 10-inch line, the dead crude Reynolds number is 327, which indicates laminar flow. Therefore, there should be relatively low mixing of dead crude and production fluids. However, as noted, pump velocity should be relatively high.

FIG. 5 is another schematic view of the subsea production architecture 10 of FIG. 1. In this view, both the injection tubing 51 in the umbilical 52 and the production riser 38 are substantially filled with the displacement fluid. No live gas should remain in the production system 10. Complete displacement of "live fluids" has taken place.

It is noted that during the displacement step 250 demonstrated in FIGS. 4 and 5, new production fluids are not being circulated into the production riser 38. This means that warm subterranean fluids are not being circulated into the production system 10. Instead, cold dead crude is being circulated. This period of "shut-in" in which new production fluids are not being moved through the production riser 38 is referred to as a "cool down" time. The cool down time should be as short as possible to avoid hydrate formation. In one aspect, the cool down time is from 4 to 10 hours, but typically it is about 8 hours.

During the cool down time, but before completion of the displacement operation, live production fluids remain in the insulated production riser 38. The insulation around the production riser 38 helps keep the uninhibited production fluids in the production flowline 24 and riser 38 above the hydrate formation temperature. Remedial operations in the subsea production system take place within the "cool down" time.

Returning to FIG. 5, as displacement of fluids from the riser 38 continues, produced fluids are urged towards the production facility 70. Arrival pressure should be no higher than normal operating pressure. For example, operating pressure may be about 18 bars (abs.). The arrival pressure preferably is reduced to roughly 16 bars (abs.), beginning about 30 minutes after the displacement step 240 begins. This increases the dead crude rate and displacement efficiency. Preferably, no arrival choking is performed as this could decrease the dead crude rate and displacement efficiency. This is in contrast to the procedure used when a pig is in the line for performing full production loop displacement.

In one aspect, the maximum allowable dead crude pumping system pressure measured at the FPSO 70 as fluids enter the umbilical is approximately 191 bars (abs.), as follows:

When a well is filled with gas, the gas gradient for the shut-in tubing pressure is 246 bars (abs.). This is based upon the density of the fluid being produced in the wellbore.

55 bars is added to account for performing scale squeeze procedures to further pressurize the flowline, producing a 301 bar (abs.) flowline pressure rating.

A dead crude gradient from the well manifold 20 to the FPSO 70 is 100.7+9.6=110.3 bars (abs.). This is based upon the density of the fluid, which is used to calculate the static head of the fluid column in the service umbilical line.

Assuming the FPSO dead crude pump dead heads (meaning that the pressure of the pump achieves a zero flow rate), the maximum allowable discharge pressure is 301−110=191 bars (abs.).

The numbers provided in this example are merely illustrative. The operator must consider the designed pressure of the subsea equipment when generating a pump discharge pressure at the FPSO 70. Stated another way, the pump displacement pressure should not exceed the maximum allowable pressure of the subsea equipment. At the same time, it is desirable to maximize displacement velocity without exceeding the maximum allowable design pressure of the subsea equipment.

The FPSO 70 processes displacement fluids in the same manner as would be done if performing displacement by pigging with dead crude. The fluids are preferably received into a high pressure test separator (not shown). The recovered liquids are preferably stored in a storage tank such as a dedicated tank for fluids that are "off-spec" for sales. Recovered gases may be routed to a flare scrubber. As the displacement step 250 continues, the separator will receive and process an increasing percentage of dead oil. Towards the end of the process, completely dead crude will flow into the separator.

It is noted that the dead crude in the service line 51 within the umbilical line 52 will be at ambient sea temperature, which is below the hydrate formation temperature of the uninhibited production fluids in the production riser 38. As a result, it is expected that the dead crude will cool the production fluids to temperatures below the uninhibited hydrate formation temperature. However, because of the depressurization 230 and repressurization 240 steps, there will be virtually no free gas phase in the system 10 once displacement begins. Therefore, the risk of hydrate plugging in the production riser 38 after displacement is low.

In addition, the LDHI in the cold dead crude displacement fluid will suppress hydrate blockage. The mechanism will be either anti-agglomeration or kinetic inhibition depending on the type of LDHI used. This further reduces the risk of hydrate plugging in the production riser 38.

Preferably, the displaced hydrocarbon fluids are monitored at the production facility 230. This is represented by Box 260 in FIG. 2.

Figure 6:
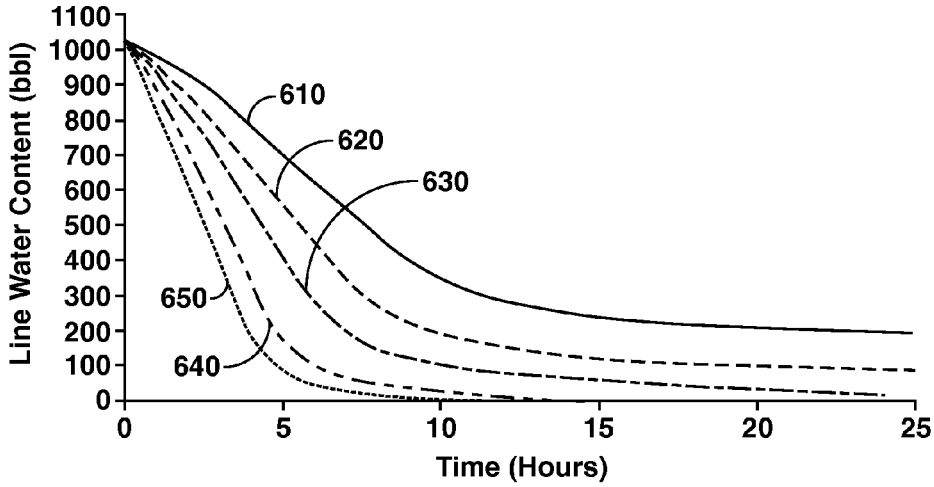
FIG. 6 is a graph demonstrating water content in the production line during displacement, as a function of displacement rate.

FIG. 6 is a graph showing the monitoring step 260. More specifically, FIG. 6 demonstrates water content in a production line during displacement, as a function of dead crude displacement rate. FIG. 6 was generated as a result of a simulation that was conducted to demonstrate displacement results from a possible set of operational parameters.

The simulation assumed that the production line 24/38 was an 8-inch line. Prior to shut-in, the production line 24/38 was tied back to subsea producer wells having a 72% watercut in year 7. The production wells were shut-in for 8 hours. Time "0" on the plot represents the beginning of the displacement process.

Five lines are shown indicating potential injection or displacement rates. Those are:

3.0 kbpd (line 610);
4.0 kbpd (line 620);
5.0 kbpd (line 630);
6.8 kbpd (line 640); and
9.0 kbpd (line 650).

Displacement at the lowest rate of 3,000 bpd produced the poorest results, while displacement at the highest rate of 9,000 bpd produced the best results. In the line 610 for the lower displacement rate (3,000 bpd), 200 barrels of water remained in the sweep even after 25 hours of pumping. In contrast, in the line 650 for the highest displacement rate (9,000 bpd), substantially all of the water had been swept after 10 hours of pumping.

As noted above, it is believed that displacement at relatively low velocities or injection rates without a pig is inefficient. A lower injection rate appears to allow for significant mixing and bypassing of production fluids by the displacing fluid. FIG. 6 confirms that a high pumping or injection rate is therefore preferred.

The dead crude injection rate will vary during displacement. The pumping rate is dependent on the contents of the USL 51, the flowlines, and the riser 38. Preferably, the dead crude pumping system is set to inject into the USL 51 from the production facility 70 at the maximum allowable pressure. In one aspect, the maximum pumping rate will range from 5,000 to 8,000 barrels per day (5 to 8 kbpd).

Returning to FIG. 2, the method 200 optionally includes repeating steps 230 through 260. This is represented by Box 270. The steps of depressurization 230, repressurization 240 and displacement 250 may be done once or multiple times during a process of hydrate mitigation to render the production system 10 safe from hydrate blockage.

It was desired to model and compare gas phase content with water phase content as a function of time. Therefore, compositional simulations were performed using OLGA™ software. OLGA™ is a transient pipeline program that simulates fluid flow. The compositional OLGA™ simulations (as opposed to standard OLGA™ simulations) are able to predict phase equilibrium more accurately than non-compositional OLGA simulations.

Figure 7:
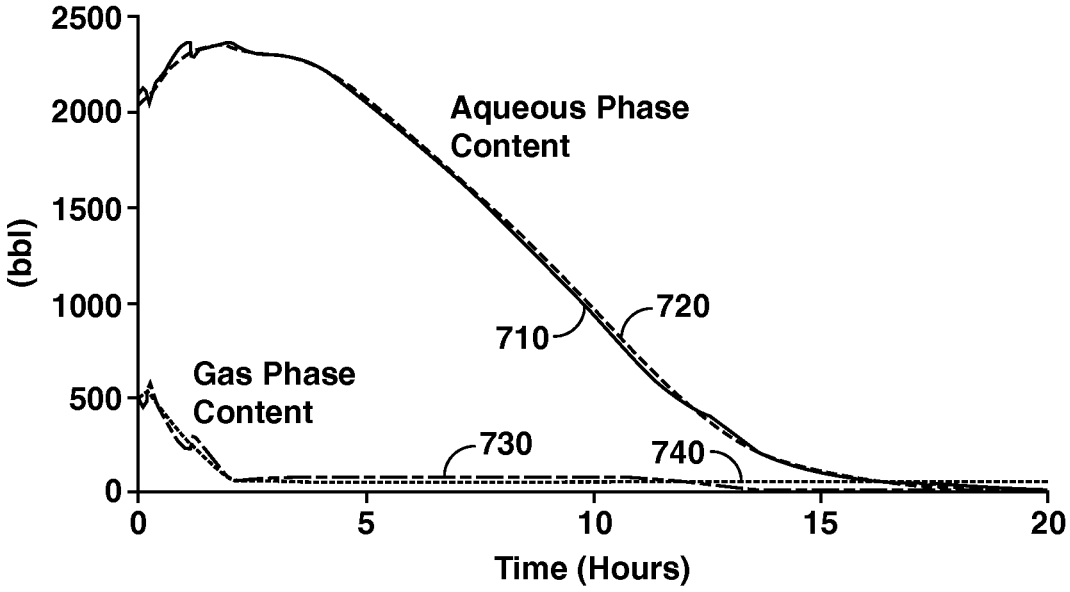
FIG. 7 is a graph comparing aqueous phase content and gas phase content in the production line during displacement, as a function of time.

The results of the simulation are found in FIG. 7. FIG. 7 is a graph comparing aqueous phase content and gas phase content in a production line during displacement, as a function of time. Four lines are shown indicating different phase contents:

Line 710 represents water or aqueous phase content for a compositional simulation;

Line 720 represents water or aqueous phase content for a black oil simulation;

Line 730 represents gas phase content for a compositional simulation; and

Line 740 represents gas phase content for a black oil simulation.

Compositional and black oil models present alternative simulation techniques. Each of these models may be used to calculate the vapor-liquid equilibrium of the fluid and the properties of the vapor and liquid phases. The compositional model is considered to be a more rigorous and computationally intensive model than the black oil model. Black oil models require less data and less computation, and are generally used if it is believed that the accuracy will be comparable to the compositional model.

First, comparing lines 710 and 720 indicating aqueous phase content, it can be seen that the compositional simulation 710 produced results markedly similar to the standard OLGA™ results 720 when black oil properties were used in the standard OLGA™ simulation. Line aqueous phase content over time was very similar. In this respect, after 16 hours of pumping, the aqueous phase content was 47 barrels for both line 710 and 720.

Second, comparing lines 730 and 740 indicating gas phase content, it can be seen that the compositional simulation 730 produced results similar to the standard OLGA™ results 740 when black oil properties were used in the standard OLGA™ simulation. However, a significant deviation occurred at about 12 hours.

By the 16 hour point, the gas phase content using standard OLGA™ results 740 was 46 barrels. However, the compositional simulation 730 was only one to four barrels. Thus, the line gas phase content predicted by the compositional simulation was significantly less than standard OLGA™ after 12 hours. The compositional simulation 730 predicts that the final free gas phase volume drops as low as one barrel. Line 740 of FIG. 7 confirms a substantial displacement of gas from the production system as of about 15 hours.

As can be seen, improved methods for subsea hydrate management in a single production flowline system are provided. For example, at least one method provides for hydrate management utilizing a chemical injection line in an umbilical for injecting a low density hydrate inhibitor. Still further, another method discloses displacement of a single production line via a service line in the subsea umbilical without, in some embodiments, the use of a thermodynamic inhibitor such as methanol, and without, in some embodiments, the use of a pig. While it will be apparent that the invention herein described is well calculated to achieve the benefits and advantages set forth above, it will be appreciated that the invention is susceptible to modification, variation and change without departing from the spirit thereof.

What is claimed is:

1. A method for managing hydrates in a subsea production system, the system having a production facility, an umbilical line for delivering displacement fluids from the production facility, at least one subsea production well, and a single production line for delivering produced fluids to the production facility, comprising:

producing hydrocarbon fluids from the at least one subsea production well and through the single production line;

shutting in the flow of produced fluids from the at least one subsea well and the production line;

depressurizing the production line to substantially reduce a solution gas concentration in the produced hydrocarbon fluids;

repressurizing the production line to urge any gas remaining in a free-gas phase in the produced fluids within the production line back into solution; and displacing production fluids within the production line by moving the displacement fluids from a service line within the umbilical line and into the production line, the displacement fluids comprising a hydrocarbon-based fluid having a low dosage hydrate inhibitor (LDHI).

2. The method of claim 1, wherein the displacement fluid is substantially without light hydrocarbon gases.

3. The method of claim 2, wherein the displacement fluid comprises dead crude, diesel, or combinations thereof.

4. The method of claim 1, wherein the LDHI is a kinetic hydrate inhibitor.

5. The method of claim 4, wherein the kinetic hydrate inhibitor is polyvinylcaprolactam or polyisopropylmethacrylamide.

6. The method of claim 1, wherein the LDHI is an anti-agglomerant.

7. The method of claim 6, wherein the anti-agglomerant is tributylhexadecylphosphonium bromide, tributylhexadecylammonium bromide, or di-butyl di-dodecylammonium bromide.

8. The method of claim 3, further comprising mixing a thermodynamic hydrate inhibitor with the displacement fluid to form an admixture prior to displacing the production fluids.

9. The method of claim 1, further comprising:

monitoring the production fluids as they are displaced from the production line to evaluate water content and gas phase.

10. The method of claim 9, further comprising:

further displacing the production fluids from the production line to urge production fluids from the production line to the production facility until substantially all water content has been removed.

11. The method of claim 9, further comprising:

further displacing the production fluids from the production line to urge substantially all of the production fluids from the production line to the production facility.

12. The method of claim 1, further comprising:

repeating the depressurizing step;

repeating the repressurizing step; and repeating the displacing step.

13. The method of claim 3, wherein the step of displacing production fluids comprises injecting the displacement fluid into the service line at a maximum allowable rate for the service line.

14. The method of claim 3, wherein the step of displacing production fluids is performed without use of a pig ahead of the displacement fluid.

15. The method of claim 3, wherein the step of displacing production fluids comprises injecting the displacement fluid into the service line at a rate of 5,000 to 9,000 bpd.

16. The method of claim 3, wherein the step of repressurizing the production line comprises pumping the displacement fluid into the service line and into the production line.

17. The method of claim 3, wherein:

the subsea production system further comprises a manifold; and the umbilical line comprises a first umbilical portion that connects the production facility with an umbilical termination assembly, and a second umbilical portion that connects the umbilical termination assembly with the manifold.

18. The method of claim 3, wherein the production facility is a floating production, storage and offloading vessel.

19. The method of claim 3, wherein the production facility is a ship-shaped gathering vessel.

20. The method of claim 3, wherein the production facility is near shore or onshore.

21. The method of claim 3, further comprising after pumping the displacement fluid through the production line: re-initiating the flow of produced fluids from the subsea well, through the single production line, and to the production facility.

22. The method of claim 21, further comprising after reinitiating the flow of produced fluids from the subsea well: transporting the produced fluids to shore.

23. A method for managing hydrates in a subsea production system, the system having at least one producing subsea well, a jumper for delivering produced fluids from the at least one subsea well to a manifold, a single, insulated production line for delivering produced fluids to a production facility from the manifold, and an umbilical for delivering chemicals to the manifold, the method comprising the steps of:

placing displacement fluids into a service line within the umbilical, with the service line being tied back to the production facility and the umbilical being in selective fluid communication with the manifold, the displacement fluids comprising a hydrocarbon-based fluid having a low dosage hydrate inhibitor (LDHI);

producing hydrocarbon fluids from the at least one producing subsea well and through the single production line;

shutting in the flow of produced fluids from the at least one subsea well and through the production line;

depressurizing the production line to substantially reduce a solution gas concentration in the produced hydrocarbon fluids;

shutting in the flow of produced fluids from the at least one subsea well and through the production line;

pumping additional displacement fluid into the service line in order to increase pressure in the production line, thereby pressurizing the production line to urge any remaining free gas phase in the produced fluids in the production line back into solution;

pumping further displacement fluid into the service line and into the production line, thereby at least partially displacing produced fluids from the production line without use of a pig;

pumping further displacement fluid through the service line and into the production line in order to more fully displace the produced fluids from the production line so as to displace the produced fluids before hydrate formation begins.

* * * * *